US007182488B2

(12) United States Patent
Hsu

(10) Patent No.: US 7,182,488 B2
(45) Date of Patent: Feb. 27, 2007

(54) WATERPROOF LAMPSHADE STRUCTURE

(76) Inventor: Huang-Hsi Hsu, 8F., No. 14, Lane 252, Chungshan N. Rd., Sec. 6, Taipei (TW)

( * ) Notice: Subject to any disclaimer, the term of this patent is extended or adjusted under 35 U.S.C. 154(b) by 94 days.

(21) Appl. No.: 11/056,250

(22) Filed: Feb. 14, 2005

(65) Prior Publication Data

US 2006/0181883 A1 Aug. 17, 2006

(51) Int. Cl.
*F21V 29/00* (2006.01)

(52) U.S. Cl. ..... 362/373; 362/294; 362/345; 362/547

(58) Field of Classification Search ..... 362/294, 362/345, 354, 356, 373, 547
See application file for complete search history.

(56) References Cited

U.S. PATENT DOCUMENTS 1,081,875 A * 12/1913 Trisler ..... 362/547
4,302,801 A * 11/1981 Duddy ..... 362/345
5,857,769 A * 1/1999 Beggs ..... 362/294
5,860,723 A * 1/1999 Domas et al. ..... 362/346

FOREIGN PATENT DOCUMENTS

JP 05242714 A * 9/1993

* cited by examiner

*Primary Examiner*—Renee Luebke
*Assistant Examiner*—Mary Zettl
(74) *Attorney, Agent, or Firm*—Bacon & Thomas PLLC

(57) ABSTRACT

The present invention discloses a waterproof lampshade structure capable of automatically discharging any rainwater that enters into the lampshade as to prevent any possible affection to the related circuits of a lamp as well as dispersing the heat produced by a light bulb from the inside of the lampshade to the outside as to effectively lower the temperature of the lampshade and greatly improve the life of the light bulb and related components and circuits.

9 Claims, 5 Drawing Sheets

WATERPROOF LAMPSHADE STRUCTURE

FIELD OF THE INVENTION

The present invention relates to a lampshade structure, more particularly to a waterproof lampshade structure capable of automatically discharging water and dispersing heat from the inside of the lampshade to the outside.

BACKGROUND OF THE INVENTION

In recent years, the pace of our life and work is extremely fast due to the severe competitions of the society, and thus people give more weights to leisure activities to release their living and working pressures during holidays or leisure time. Among various leisure activities, barbeque is the most popular one which is suitable for the participation of the whole family, relatives and friends. Particularly with the spacious backyards in European or American families, barbeque has become the most popular leisure-time social activity. Therefore, the European or American families take barbeque stoves and accessories required for the barbeque activity very seriously.

In FIG. 1, a traditional rotisserie 60 comes with a hollow barbeque grill 61 with a U-shape cross section, and the barbeque grill 61 comprises: an accommodating space 611 therein for accommodating the related barbeque accessories such as a stove, a grate and charcoals (not shown in the figure); a first fixed stand 62 and a second fixed stand 63 being disposed on both opposite sidewalls of the barbeque grill 61 respectively; a motor module 64 being installed on the second fixed stand 63; an axle hole 642 being disposed on a lateral side of the motor module 64; a rod 70 being inserted into the axle hole 642; a notch 624 being disposed at the first fixed stand 62 on the other end of the rod 70, a pair of brochette forks 651 is disposed on an appropriate position of the rod 70, such that after a barbeque food item 80 is fixed onto the rod 70 and the brochette fork 651, the barbeque food item 80 is rotated on the rod 70 by the motor module 64 and cooked by the charcoals in the barbeque grill 61. The motor module 64 connects to a power supply through a power cable 643 and supplies the electric power required for the normal operation of a motor (not shown in the figure).

If the foregoing rotisserie 60 is used for barbequing food in daytime while there are bright light and clear visibility, users can visually check whether or not the barbeque food item 80 is cooked, but if the barbeque activity is held at nighttime while it is dark or having a poor visibility, then users cannot visually check whether or not a barbeque food item 80 is cooked. Therefore, users usually have to slide and taste a small piece of the barbeque food item 80 to determine the appropriate cooked level of the barbeque food item 80. If a user eats some of the uncooked barbeque food item 80, the user may get sick easily by swallowing the germs that remain in the uncooked food and may jeopardize our health.

In view of the foregoing shortcomings, some barbeque grill manufacturers design a barbeque grill that comes with a lamp, so that users can see and determine the cooked level of the barbeque food item 80 easily in a dark environment with a poor visibility. However, most of the barbeque grills are placed in the backyard of an American of European family, or the barbeque activity is generally held outdoors in an open space, and thus a way of preventing rainwater from entering into the electric circuit in a lampshade should be taken into consideration for the design of a lamp to be used outdoors. In the meantime, the design should be able to disperse the heat produced by a light bulb to the outside for prevent accidents caused by an overheated lampshade.

SUMMARY OF THE INVENTION

In view of the shortcomings of the foregoing traditional barbeque including a lamp that is not waterproof and unable to disperse heat effectively, the inventor of the present invention based on years of experience in the related industry to conduct extensive researches and experiments to overcome the shortcomings of the prior art and finally invented a waterproof lampshade structure in accordance with the present invention.

Therefore, it is a primary objective of the present invention to provide a waterproof lampshade structure capable of automatically discharging any rainwater that enters into the lampshade as to prevent a possible affection to the related circuits and dispersing the heat produced by a light bulb from the inside of the lampshade to the outside as to effectively lower the temperature inside the lampshade and greatly improve the life of the light bulb and the related components and circuits.

Another objective of the present invention is to provide a waterproof lampshade structure comprising an inner shade and an outer shade, wherein the outer shade is disposed on the external periphery of the inner shade and keeps an appropriate interval from each other; a light bulb and a lamp holder are accommodated at the internal edge of the inner shade, and the lamp holder can fix a closed end of the inner and outer shades onto a support rod; a transparent lid is provided for waterproofing an open end of the inner and outer shades; a plurality of protrusions is protruded from the outer shade, each protrusion having a weephole disposed on one side of the transparent lid for discharging any rainwater that falls into the space between the inner shade and the outer shade; and the inner shade has a plurality of bulges, each bulge being conical in shape and having a ventilation hole disposed at its top for discharging the heat produced by the light bulb to the space between the inner shade and the outer shade and then to the outside through the weepholes disposed on the protrusions.

A further objective of the present invention is to provide a waterproof lampshade structure comprising an outer shade that waterproofs an external edge of an inner shade and having an appropriate interval between the outer and inner shades, and the lower edge of a weephole on the outer shade presses against the external edge of the inner shade as to secure and couple the closed end of the inner and outer shades integrally onto a support rod. The gap between the inner and outer shades corresponding to the bulges and the protrusions is partitioned into an independent space for discharging water and dispersing heat, and an open end of the inner shade is waterproofed by a transparent lid.

Another further objective of the present invention is to provide a waterproof lampshade structure, wherein the external edge of the inner shade presses against the lower edge of each weephole disposed on the internal edge of the outer shade; an appropriate interval is kept between the inner and outer shades; the closed end of the inner and outer shades is secured onto a support rod, such that when the inner and outer shades are integrally coupled, an interval between the inner and outer shades corresponding to the bulges and protrusions is partitioned into an independent space for discharging water and dispersing heat, and the open end of the outer shade is waterproofed by a transparent lid.

The above and other objects, features and advantages of the present invention will become apparent from the following detailed description taken with the accompanying drawings.

DETAILED DESCRIPTION OF THE PREFERRED EMBODIMENTS

Figure 1:
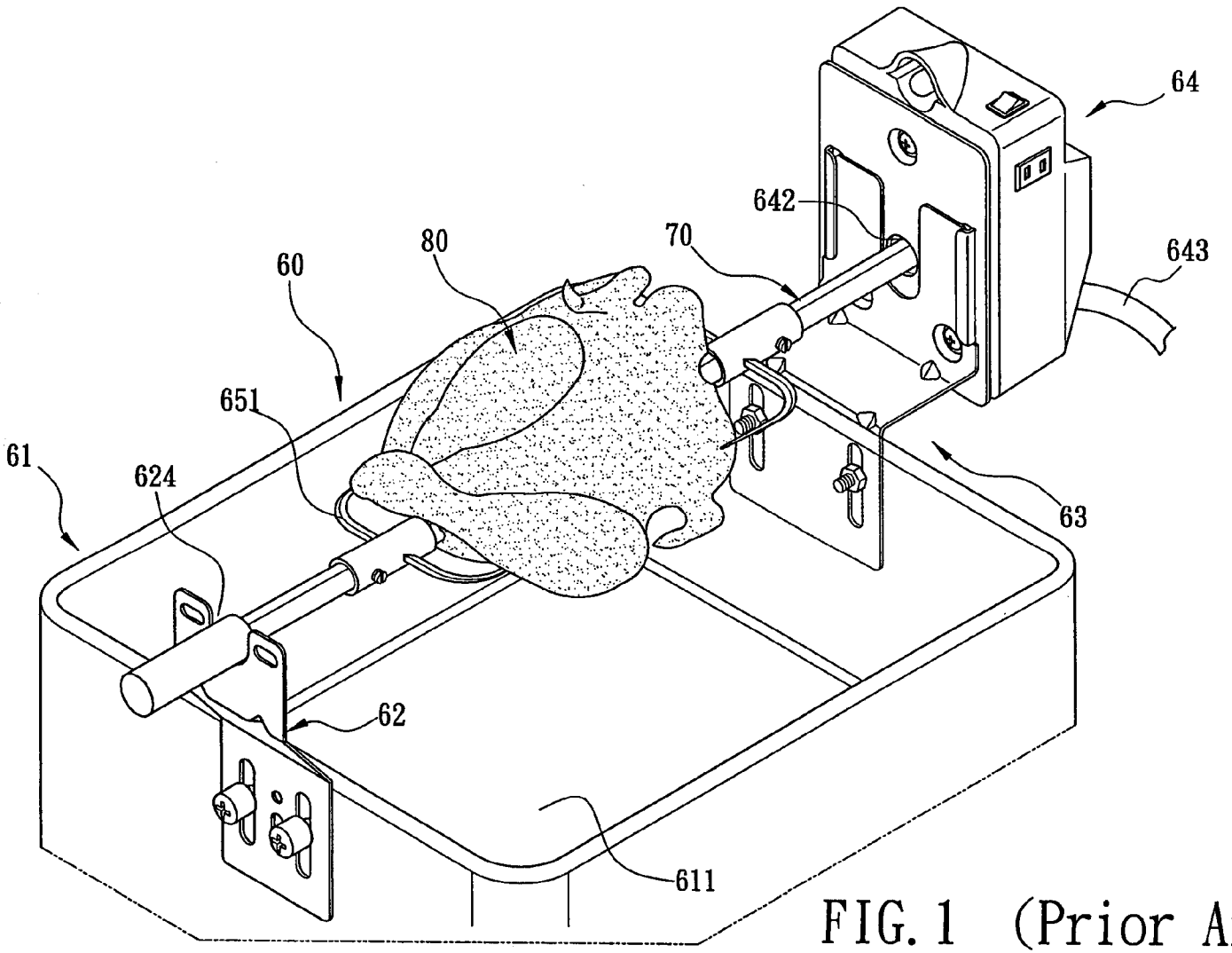
FIG. 1 (Prior Art)
FIG. 1 is a schematic view of the structure of a prior-art rotisserie.
Figure 2:
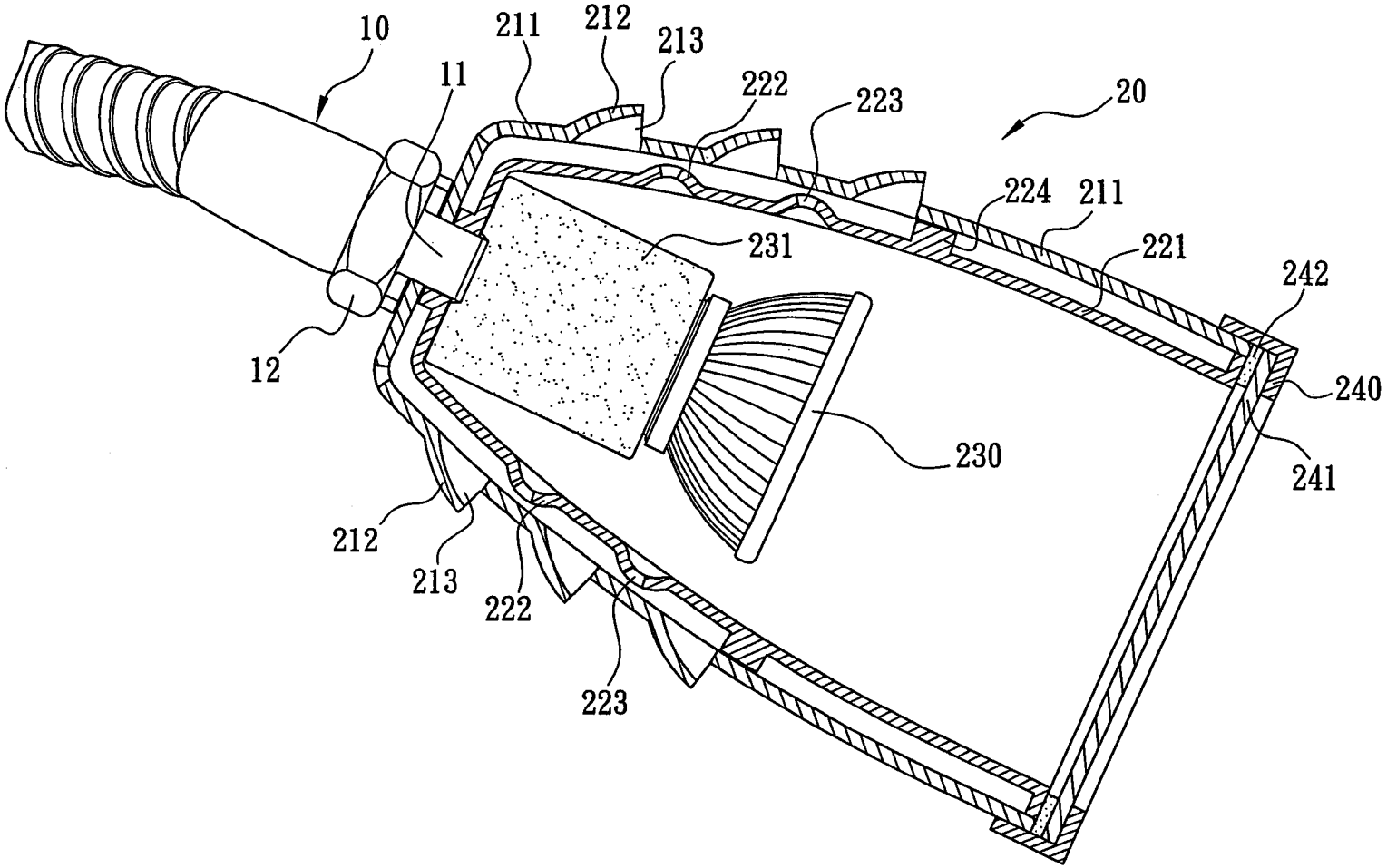
FIG. 2 is a sectional view of a first preferred embodiment of the invention.
Figure 3:
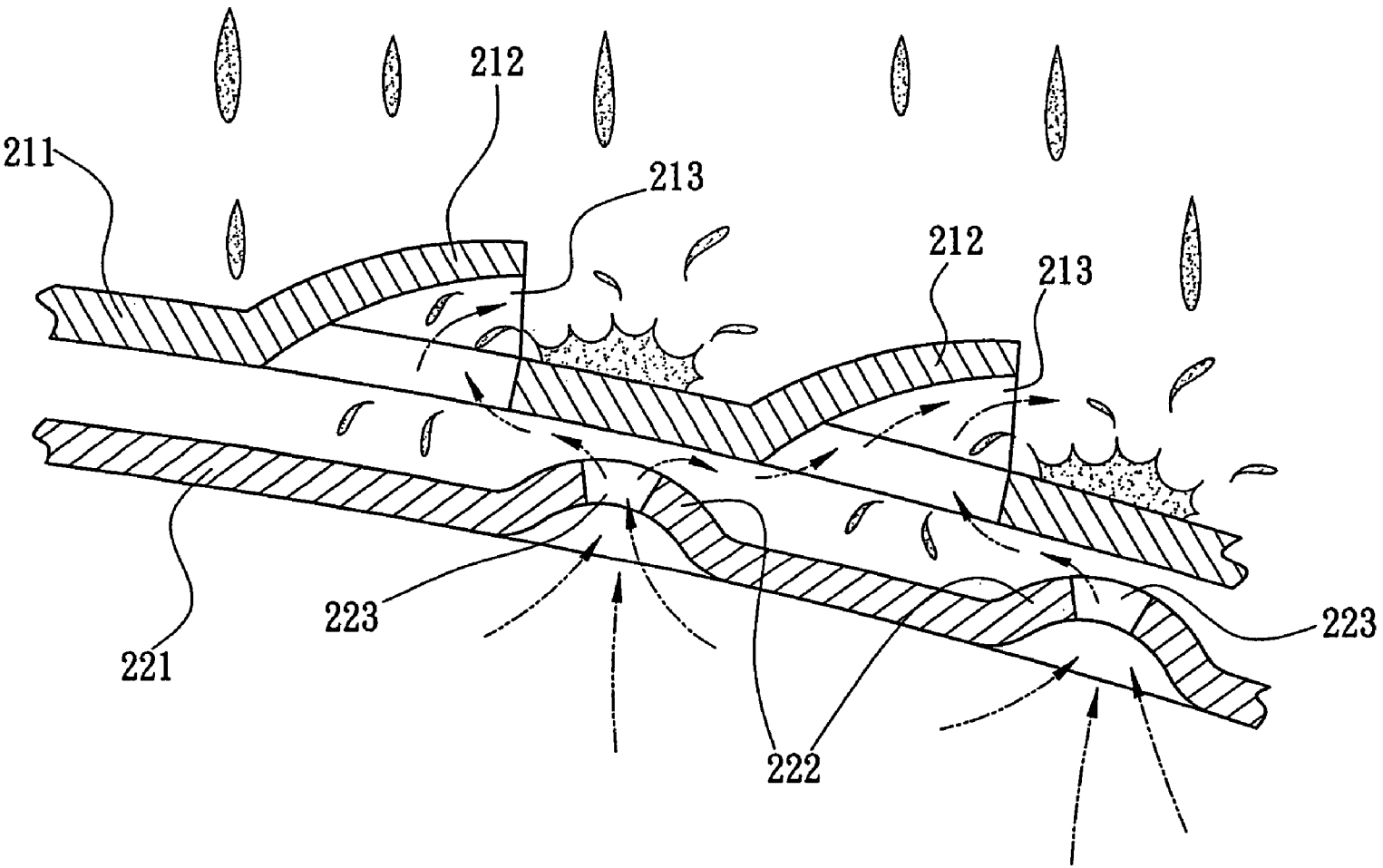
FIG. 3 is an enlarged view of a part of FIG. 2.

Please refer to FIG. 2 for a preferred embodiment of the present invention. In FIG. 2, a waterproof lampshade structure 20 comprises an inner shade 221 and an outer shade 211; wherein the outer shade 211 is disposed at the external edge of the inner shade 221 and an appropriate interval is kept between the outer and inner shades 221, 211; a penetrating hole is disposed at the corresponding closed end of the outer shade 211 and the inner shade 221; a screw rod 11 disposed on a support rod 10 is coupled to a lamp holder 231 after passing through each penetrating hole; a nut 12 installed on the support rod 10 is adjusted to secure and couple a closed end of the inner shade 221 and the outer shade 211 integrally onto the support rod 10; a power cable (not shown in the figure) is disposed in the support rod 10, and one end of the power cable is electrically coupled to an electric contact point in the lamp holder 231, so that when a light bulb 230 is installed to the lamp holder 231, the power cable will supply the required electric power for the light bulb 230 through the light holder 231 for the desired illumination. In this preferred embodiment, a lid 240 is coupled to the corresponding open end of the inner shade 221 and the outer shade 211, and the lid 240 has an opening at its center; its internal edge presses against the external edge of a piece of transparent glass 241; and a watertight washer 242 is installed at the open end of the inner shade 221 and the outer shade 211, such that the lid 240 is fixed to the open end of the inner shade 221 and the outer shade 211 as to waterproof the open end and allow the light produced by the light bulb 230 in the waterproof lampshade 20 to be emitted to the outside through the transparent glass 241.

Please refer to FIG. 2 again. The preferred embodiment of the present invention further comprises a circular protruded rib 224 disposed between the inner shade 221 and the outer shade 211 corresponding to the lower edge of each weephole 213 for securing the closed end of the inner shade 221 and the outer shade 211 onto the support rod 10, so that when the protruded rib 224 is integrally coupled with the inner shade 221 and the outer shade 211, the interval between the inner shade 221 and the outer shade 211 corresponding to the bulges 222 and the protrusions 212 is partitioned into an independent space for discharging water and dispersing hot air.

Please refer to FIG. 2 again. The preferred embodiment of the present invention further comprises a circular protruded rib 224 disposed between the inner shade 221 and the outer shade 211 corresponding to the lower edge of each weephole 213 for securing the close end of the inner shade 221 and the outer shade 211 onto the support rod 10, so that when the protruded rib 224 is integrally coupled with the inner shade 221 and the outer shade 211, the interval between the inner shade 221 and the outer shade 211 corresponding to the bulges 222 and the protrusions 212 is partitioned into an independent space for discharging water and dispersing hot air.

Figure 4:
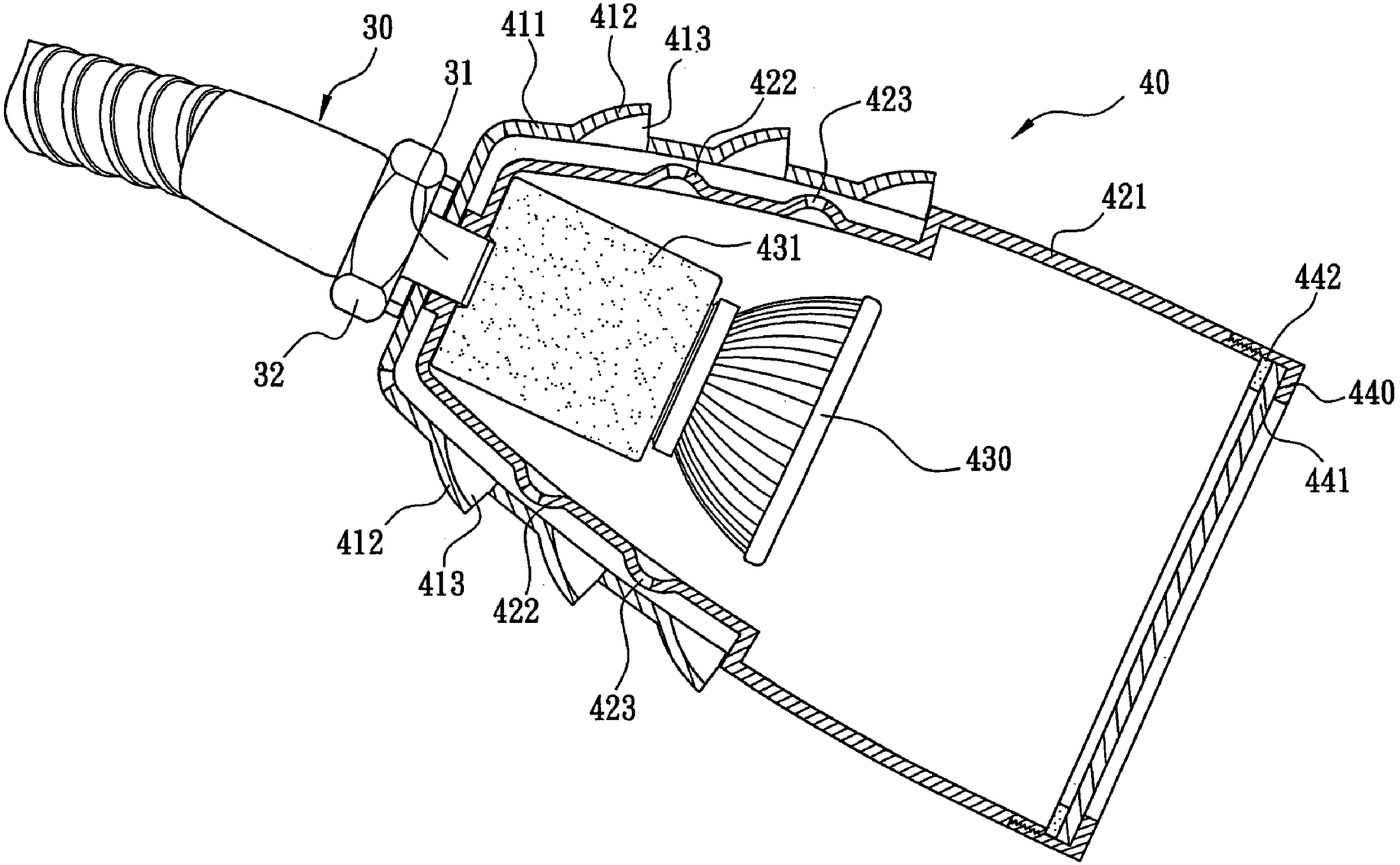
FIG. 4 is a sectional view of a second preferred embodiment of the invention.

Please refer to FIG. 4 for another preferred embodiment. In FIG. 4, the structure of the waterproof lampshade 40 comprises an inner shade 421 and an outer shade 411, wherein a plurality of bulges 422 is disposed at the external edge of the inner shade 421 and proximate to the closed end of the inner shade 421, and each bulge 422 is substantially conical in shape and has a ventilation hole 423 at its top. The outer shade 411 is disposed on the inner shade 421 for waterproofing the periphery of an end of the inner shade 421 that has the bulges 422 and keeps an appropriate interval from each other. The outer shade 411 comprises a plurality of protrusions 412 being protruded thereon and each protrusion 412 has a weephole 413 at the side facing the open end, and the edge of the open end presses on the external edge of the inner shade 421, and a penetrating hole is disposed at a closed end of the outer shade 411 and the inner shade 421; a screw rod 31 disposed on a support rod 30 is coupled with a lamp holder 431 after passing through each penetrating hole in sequence, and a nut 32 disposed on the support rod 30 is adjusted to secure one end of the inner shade 421 and the outer shade 411 integrally onto the support rod 30, such that the interval between the inner shade 421 and the outer shade 411 corresponding to the bulges 422 and the protrusions 412 is partitioned into an independent space for discharging water and dispersing hot air. A lid 440 is coupled to the open end of the inner shade 421, and the lid 440 has an opening at its center and its inner edge presses on the external edge of a piece of transparent glass 441, and a watertight washer 442 is installed between the transparent glass 441 and the open end of the inner shade 421. Therefore, if the lid 440 is coupled to the open end of the inner shade 421, the open end will be watertight, and the light produced by the light bulb 430 in the waterproof lampshade 40 can be emitted to the outside through the transparent glass 441.

Figure 5:
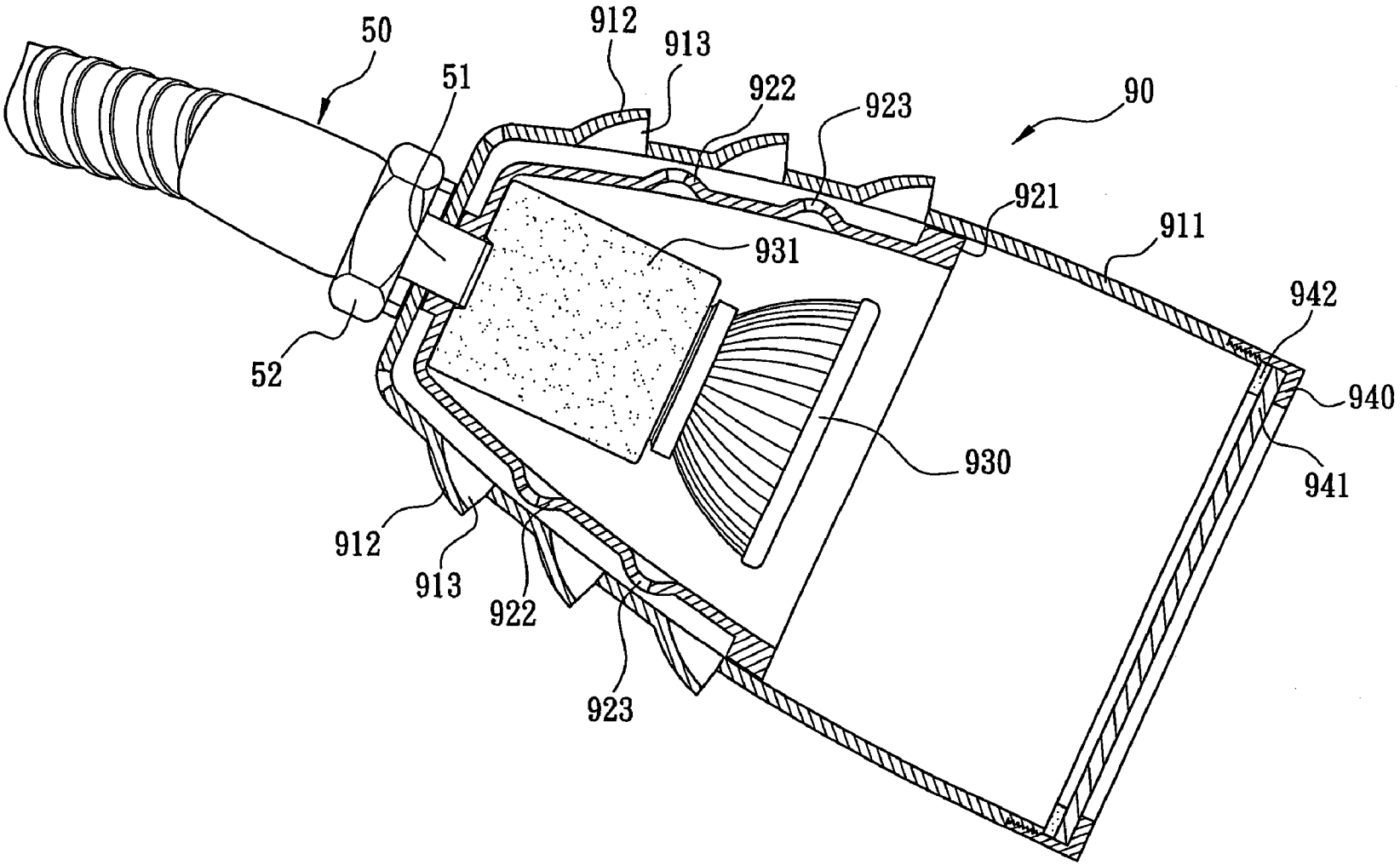
FIG. 5 is a sectional view of a third preferred embodiment of the invention.

Similarly, in another preferred embodiment of the present invention as shown in FIG. 5, the structure of the waterproof lampshade 90 comprises an inner shade 921 and an outer shade 911, wherein a plurality of protrusions 912 is disposed on the external shade 911 and proximate to the closed end of the external shade 911, and a ventilation hole 913 is disposed on the protrusion 912 facing the open end. The inner shade 921 has a plurality of bulges 922, and each bulge 922 is substantially conical in shape and has a ventilation hole 923 disposed at its top, and the edge of an open end of the inner shade 921 presses on the lower edge of each weephole 913 disposed at the internal edge of the external shade 911 to keep an appropriate interval from each other. A penetrating hole is disposed at the corresponding closed end of the outer shade 911 and the inner shade 921; a screw rod 51 disposed on a support rod 50 is coupled to a lamp holder 931 after passing through each penetrating hole; a nut 52 installed to the support rod 50 is adjusted to secure a closed end of the inner shade 921 and the outer shade 911 integrally onto the support rod 50, such that an interval between the inner shade 921 and the outer shade 911 corresponding to the bulges 922 and the protrusions 912 is partitioned into an independent space for discharging water and dispersing hot air. A lid 940 is coupled to the corresponding open end of the external shade 911, and the lid 940 has an opening at its center; its internal edge presses on the external edge of a piece of transparent glass 941; and a watertight washer 942 is installed between the transparent glass 941 and the open end of the outer shade 911 such that the lid 940 is fixed to the open end of the outer shade 911 as to waterproof the open end and the light produced by the light bulb 930 in the waterproof lampshade 90 can be emitted to the outside through the transparent glass 941.

To prevent rainwater from entering into the space between inner shade 221, 421, 921 and the outer shade 211, 411, 911 through each weephole 213, 413, 913 or directly into the ventilation hole 223, 423, 923 disposed at the top of the bulge 222, 422, 922 on the inner shade 221, 421, 921 for the foregoing preferred embodiments of the present invention, the protrusions 212, 412, 912 and the bulges 222, 422, 922 or the weepholes 213, 413, 913 and the ventilation hole 223, 423, 923 are aligned alternately with each other to assure a better waterproof effect.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A waterproof lampshade structure, comprising:

an inner shade, having a plurality of bulges, each bulge being conical in shape and having a ventilation hole disposed at its top;

a lamp holder, being disposed at the internal edge of said inner shade;

an outer shade, being disposed at the external edge of said inner shade and having an appropriate interval between said inner and outer shades, and a closed end of said outer and inner shades being fixed onto a support rod by said lamp holder;

a transparent lid, for waterproofing an open end of said outer and inner shades; and a plurality of protrusions, being protruded from said outer shade and each protrusion having a weephole disposed on the side facing said transparent lid.

2. The waterproof lampshade structure of claim 1 further comprising a circular protruded rib being disposed between said inner and outer shades corresponding to the lower edge of said each weephole for securing a closed end of said inner and outer shades to said support rod, such that when said protruded rib is coupled with said inner and outer shades, an interval disposed between said inner and outer shades corresponding to said bulges and said protrusions is partitioned into an independent space for discharging water and dispersing hot air.

3. The waterproof lampshade structure of claim 1, wherein said protrusions and said bulges are aligned alternately with each other.

4. A waterproof lampshade structure, comprising:

an inner shade, having a plurality of bulges disposed proximate to a closed end of said inner shade, each bulge being conical in shape and having a ventilation hole disposed at its top and a transparent lid for waterproofing an open end of said inner shade; a lamp holder, being disposed at the internal edge of said inner shade;

an outer shade, for waterproofing the external edge of said bulge disposed on said inner shade and having an appropriate interval between said inner and outer shades, and a corresponding closed end of said outer and inner shades being fixed onto a support rod by said lamp holder; and a plurality of protrusions, being protruded from said outer shade and each protrusion having a weephole disposed on the side facing said transparent lid.

5. The waterproof lampshade structure of claim 4, wherein said open end of said outer shade is provided for waterproofing the external edge of said inner shade, such that when the corresponding closed end of said inner and outer shades is secured onto said support rod, an interval between said inner and outer shades corresponding to said bulges and said protrusions is partitioned into an independent space for discharging water and dispersing hot air.

6. The waterproof lampshade structure of claim 4, wherein said protrusions and said bulges are aligned alternately with each other.

7. A waterproof lampshade structure, comprising:

an inner shade, having a plurality of bulges disposed on said inner shade, each bulge being conical in shape and having a ventilation hole disposed at its top;

a lamp holder, being disposed at the inner edge of said inner shade; and an outer shade, having an opening being waterproofed by a transparent lid and a plurality of protrusions being disposed on the external edge of said inner shade and proximate to said open end, each of the said protrusions having a weephole disposed on the side facing said transparent lid and said inner shade being disposed at the external edge of said outer shade and said plurality of protrusions and keeping an appropriate interval between said inner and outer shades, and a closed end of said outer and inner shades being fixed onto a support rod by said lamp holder.

8. The waterproof lampshade structure of claim 7, wherein said open end of said inner shade is provided for waterproofing the internal edge of said outer shade, such that when the corresponding closed end of said inner and outer shades is secured onto said support rod, an interval between said inner and outer shades corresponding to said bulges and said protrusions is partitioned into an independent space for discharging water and dispersing hot air.

9. The waterproof lampshade structure of claim 7, wherein said protrusions and said bulges are aligned alternately with each other.

* * * * *